United States Patent [19]

Bogar, Jr.

[11] 4,108,313

[45] Aug. 22, 1978

[54] VEHICLE MOUNTED GUN RACK WITH MOUNTING BRACKETS

[76] Inventor: Earl M. Bogar, Jr., P.O. Box 4152, Houston, Tex. 77001

[21] Appl. No.: 796,474

[22] Filed: May 12, 1977

[51] Int. Cl.[2] ..... A47F 5/08; A47F 7/00

[52] U.S. Cl. ..... 211/64; 211/87; 224/42.45 R

[58] Field of Search ..... 211/64, 63, 68, 67, 211/60 R, 60 SK, 87, 86, 103; 224/42.45 R, 42.45 A, 29 R; 248/201, 224.4, 225.1, 475 R, 295

[56] References Cited

U.S. PATENT DOCUMENTS

| | | | |
|---|---|---|---|
| 1,632,036 | 6/1927 | Mullen | 248/295 X |
| 2,271,928 | 2/1942 | Sims | 248/224.4 |
| 2,728,503 | 12/1955 | Kramer | 224/42.45 A |
| 3,294,247 | 12/1966 | Norrington | 211/64 |
| 3,865,338 | 2/1975 | Campbell | 248/295 |
| 3,931,893 | 1/1976 | Elkins et al. | 211/64 |

*Primary Examiner*—Ramon S. Britts
*Attorney, Agent, or Firm*—Clarence A. O'Brien; Harvey B. Jacobson

[57] ABSTRACT

A mounting rack for firearms, such as rifles, shotguns, and the like, which mounting rack can be rapidly installed under spaced portions of molding typically encircling a vehicle window. The present mounting rack comprises laterally spaced support elements, each support element being formed of coacting slide members, at least one of which members has cradle elements carried thereon. The coacting slide members each have one blade member attached thereto at opposite ends of said slide members, the blade members being received between the molding and the window glass of a vehicle or within mounting brackets located on a desired surface.

6 Claims, 8 Drawing Figures

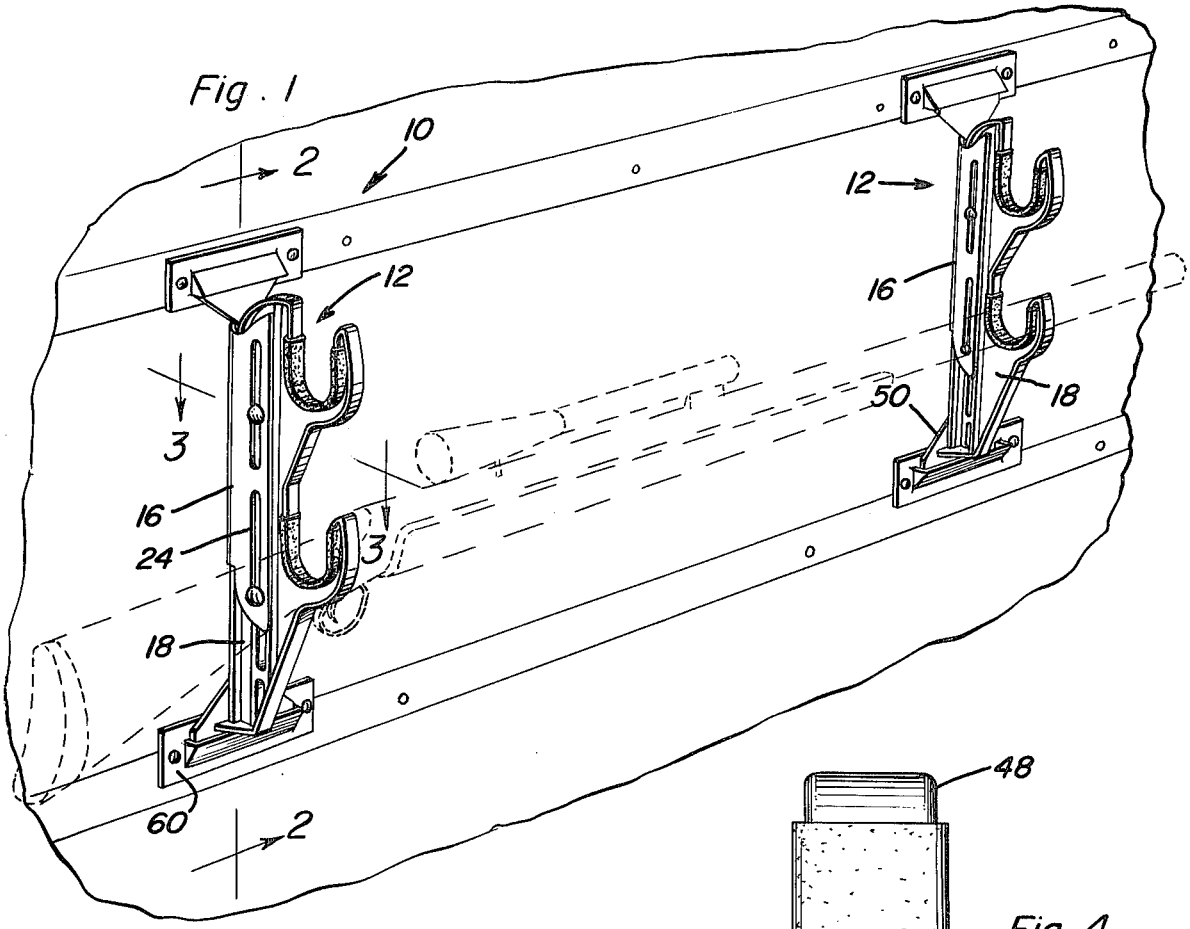
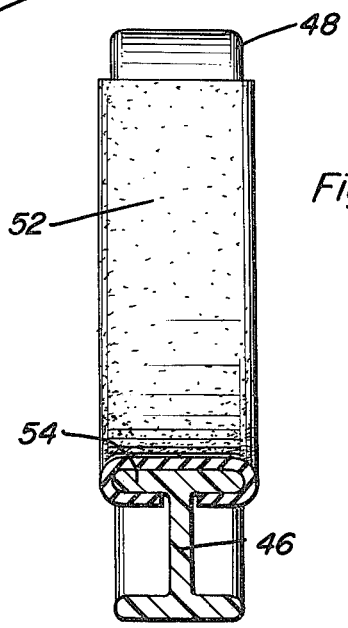
Fig. 4
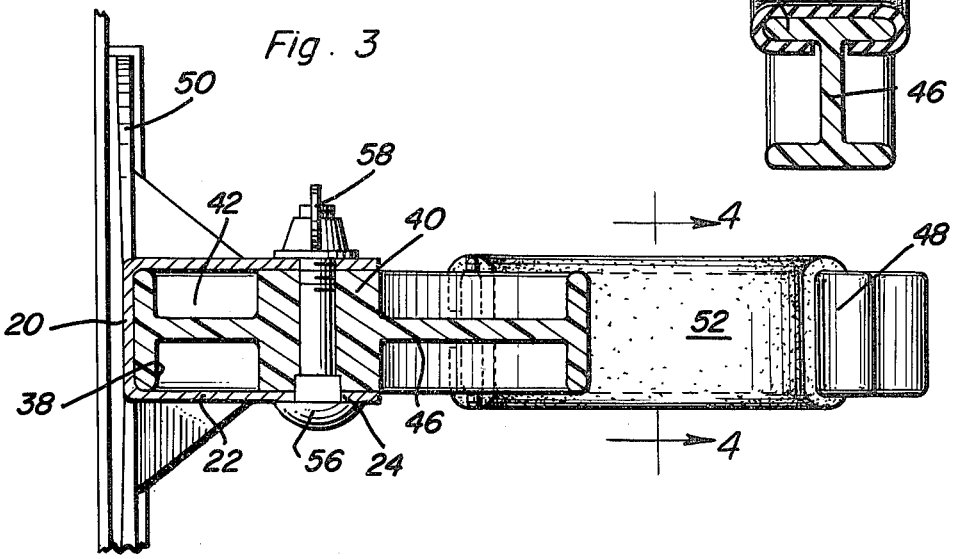

48
44
20
56
48
52
44
28
40
38
18
50
42
60

12
32
26
22
16
24
30
48
52
40
18
42
50

VEHICLE MOUNTED GUN RACK WITH MOUNTING BRACKETS

BACKGROUND OF THE INVENTION

Gun racks mountable on rear or side windows of vehicles have previously been disclosed in the art. Such racks have also taken the form of two spaced, unconnected members, the ends of which are adapted to fit between the rubber gasket and the window glass, the members being each adjustable in length to adapt to window frames of several standard sizes. Elkins et al, in U.S. Pat. No. 3,876,079, provides such a structure, the gun rack members therein disclosed being installable in spaced superimposed relationship upon a window of a vehicle without the need to drill holes or provide fittings on the window for mounting of the gun rack members. The Elkins et al device is adjustable within a given range of lengths and, as such, can fit windows of several standard sizes. The present invention provides a gun mounting rack useful in vehicles in a manner similar to that of the Elkins et al device; however, the present mounting rack provides structure capable of continuous adjustment of the respective lengths of spaced rack members throughout the full relative extension of coacting slide elements forming each rack member. As a result of this structure, the present mounting rack members can be caused to fit vehicular windows of any possible size as well as to enable mounting, with the addition of bracket members, to walls and other structural supports, the present rack members being extendable to accommodate a desired vertical spacing between the bracket members.

Issued U.S. patents in addition to the Elkins et al patent previously referred to and which may be pertinent to the presently disclosed invention include:

Nos. 2,536,293 — Koses - January, 1951
2,550,796 — Francis - May, 1951
2,599,824 — Griffin - June, 1952
2,746,661 — Kaplan - May, 1956
2,764,332 — Lemley - September, 1956
3,007,582 — Lindstrom - November, 1961
3,294,247 — Norrington - December, 1966.

SUMMARY OF THE INVENTION

The present invention provides a mounting rack for rifles and similar firearms, the rack comprising laterally spaced support members secured in spaced relation to a window of a vehicle or to brackets mounted on a wall or similar supporting structure. Each support member is comprised of first and second coacting slide elements which are movable relative to each other, each element having opposed support blades which can be inserted between the rubber molding and the glass portion of a vehicle window or which can be inserted within vertically spaced mounting brackets provided on a wall or the like. One of the slide elements carries at least one cradle member, two of the spaced support members providing support for a rifle or the like at two spaced points along the length of said rifle.

The support members of the invention are extendible to lengths varying from less than the length-wise dimension of the longest slide element thereof to nearly the combined lengths of the two slide elements. A major portion of one of the slide elements is formed into a U-shaped track within which the other of the slide elements is free to slide longitudinally. Each of the slide elements has spaced slots formed longitudinally thereof, at least certain portions of the slots aligning during the full range of relative motion between the slide elements to allow fastening members, such as a bolt and winged nut, to be extended through the slots to secure the slide elements together in a desired lengthwise relation. The blade members at opposed ends of each support member are tilted toward the rear of said support member to cause the body of the support member to be spaced from the window glass or other surface surmounted thereby. A rifle or other firearm thus placed in the cradle members formed on one of the slide elements is thereby releasably held in spaced relation from a window glass or wall surface.

Accordingly, it is an object of the invention to provide an improved mounting rack for rifles and similar firearms which can be mounted in combination with a window assembly of a vehicle.

It is another object of the invention to provide a mounting rack for rifles or other elongated items which can be easily installed between the molding and glass pane of a window in a vehicle, the mounting rack being readily adjustable to window assembly widths within a full range encompassing distances less than to greater than the length of support members comprising the mounting rack.

It is a further object of the invention to provide a mounting rack which can be mounted between vertically spaced brackets on a wall or other supporting structure.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the present mounting rack in an assembled configuration;

FIG. 3 is a sectional view taken along line 3—3 of FIG. 1;

FIG. 4 is a sectional view taken along line 4—4 of FIG. 3;

DESCRIPTION OF THE PREFERRED EMBODIMENTS

Figure 5:
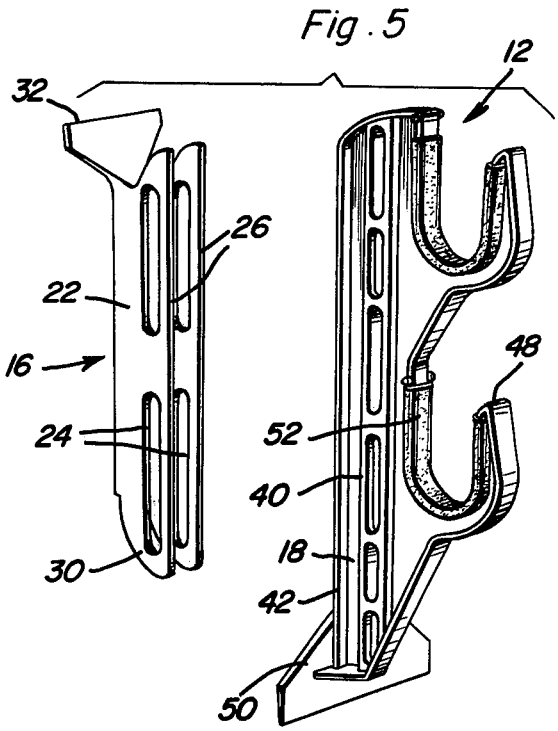
FIG. 5 is an idealized assembly view in perspective of the two major structural elements comprising the invention.

Referring now to the drawings and particularly to FIG. 1, the present gun mounting rack is seen generally at 10 to comprise two identical support members 12, the support members 12 being spaced laterally apart a distance sufficient to allow mounting therebetween of a rifle, such as rifle 14 shown in phantom. The support members 12 are each mounted to a suitable surface at upper and lower ends thereof as will be further described hereinafter. Since the support members 12 are identical in structure and operation, a description of one will suffice for disclosure of the features of both. Accordingly, as further seen in FIGS. 2 and 5, each support member 12 is seen to be comprised of slide elements 16 and 18, the slide element 16 comprising a U-shaped track bounded by a rear wall 20 and side walls 22 connected to said wall 20 and extending perpendicularly thereto. The side walls 22 each have at least two elongated slots 24 disposed therein and lying along vertical edges 26, the slots 24 being laterally aligned with each other. The side walls 22 extend beyond lower edge 28 of the rear wall 20 and curve laterally therefrom to form curved wall portions 30, the curved portions 30 terminating at the intersections of the curved edges respectively defining said portions with the vertical edges 26. The curved portions 30 thus extend vertically downwardly when the support members 12 are mounted to perform a function to be described hereinafter. The rear wall 20 at the upper end of the slide element 16 laterally expands along each side thereof to form a blade member 32, the blade member 32 extending rearwardly of the plane of the rear wall 20, the plane in which said blade member 32 lies being disposed at a slight angle to the plane of the rear walls 20. Upper edges 34 of the side walls 22 of the slide element 16 extend essentially from the juncture of the rear wall 20 and the blade member 32 at an angle to the rear wall 20 to intersect the vertical edges 26 and thus form pointed tongues 36. The tongues 36 can be used as a mounting for a hat or article of clothing when the support members 12 are installed on a support structure. The slide element 16 is preferably formed of metal due to the heavyduty use of the U-shaped track formed by the walls 20 and 22, the slide element 18 fitting within the open-sided track channel defined by said walls and being vertically movable therewithin.

The slide element 18, as can also be seen in FIG. 3, has a rear wall 38 which is connected to a central bar member 40 by a vertical structural element 42, the element 42 extending perpendicularly to spaced parallel walls of the rear wall 18 and central bar member 40 and connecting thereto along the respective lengths thereof. The bar member 40 has a plurality of elongated slots 44 formed therethrough and extending between parallel side walls of said bar member 40, the slots 44 being spaced vertically along the bar member 40. A web portion 46 extends from the forward wall surface of the bar member 40 to form curved cradle members 48, two of the cradle members 48 being preferably disposed in vertically spaced relation forward of the bar member 40. The upper end of the slide element 18 curves slightly from the rear wall 38 to intersect with the rear portion of the upper cradle member 40. The lower end of the slide element 18 has an enlarged blade member 50 extending from the rear wall 38, the plane in which the blade member 50 lies being disposed at a slight angle to the plane of the rear wall 38. The lower edge of the slide element 18 extends normally from the rear wall 38 and then extends upwardly at an angle to intersect the lower edge of the bar member 40 and to define the lower edge of the web portion 46, said lower edge terminating at its intersection with a lower curved portion of the lowermost cradle member 48.

As can be seen in the drawings and particularly in FIGS. 3 and 4, split oval shaped resilient pads 52 are received on flanges 54 which extend laterally from the major body portions of the cradle members 48, the flanges 54 essentially being continuous about the periphery of the cradle members 48 and of the web portion 46. The pads 52 prevent scratching or marring of the finish of a rifle placed within the cradle members 48.

Figure 6:
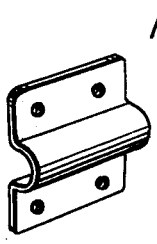
FIG. 6 is a perspective view of one embodiment of a mounting bracket alternately useful with the invention.
Figure 7:
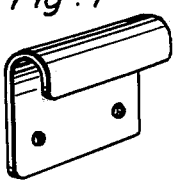
FIG. 7 is a perspective view of a second embodiment of a mounting bracket.
Figure 8:
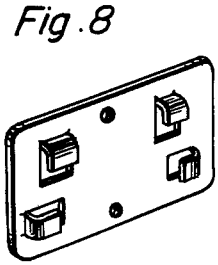
FIG. 8 is a perspective view of a third embodiment of a mounting bracket.

The slide element 18 is dimensioned such that it can be slidably received within the U-shaped track formed by the slide element 16. When the slide elements 16 and 18 are thus brought together, at least portions of the slots 24 and 44 respectively disposed in said elements 16 and 18 align regardless of the relative vertical positions of the slide elements 16 and 18. Further, except when the upper end of the slide element 18 is substantially displaced into a juxtaposed relationship with the lower edge 28 of the rear wall 20 of the element 16, at least two spaced aligned apertures are formed by the slots 24 and 44 laterally through the support member 12. Therefore, two bolts 56 can be inserted through the aligned slots 24 and 44 and secured by wing nuts 58 to hold the slide elements 16 and 18 together in a desired relative position. Therefore, as is seen in FIG. 1, the blade members 32 and 50 can be inserted into recesses formed in mounting brackets 60 or can be fitted between the molding surrounding a window in a vehicle and the glass pane itself such as is described in U.S. Pat. No. 3,876,079. When mounted to a wall such as is shown in FIG. 1, the brackets 60 are vertically spaced at a desired distance, the distance often being dictated by the location of suitable structure on which to secure the brackets 60. The brackets 60, forms of which are shown in FIGS. 6, 7, and 8, provide facing recesses defining by structural tabs or curved portions and the like which receive the blade members 32 and 50 therewithin, the slide elements 16 and 18 being extended (or contracted) relative to each other to fit in the brackets 60. The slide elements 16 and 18 are then bolted together as aforesaid.

Figure 2:
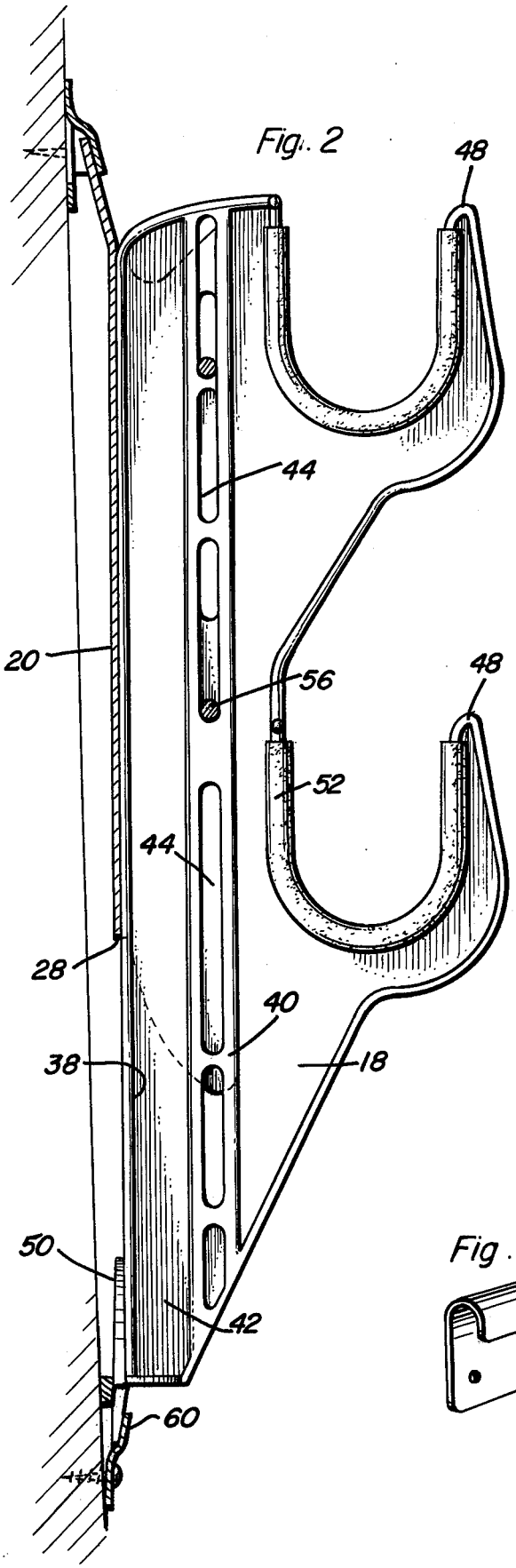
FIG. 2 is an elevational view in partial section taken along line 2—2 of FIG. 1.

As particularly shown in FIG. 2, the rear wall 20 of the slide element 16 is caused to be spaced from the surface surmounted by the support member 12. Due to the rearward tilt of the blade members 32 and 50, the support members 12 are caused to remain out of contact with the surface surmounted thereby. Thus, when the rack 10 is mounted across a window such as in a vehicle, no load is transmitted from the body of the support members 12 to the window glass.

The support members 12 can be mounted across distances ranging from less than the length of the slide member 18 alone to a length of nearly the combined lengths of the two slide elements 16 and 18. In particular, the shorter length of the rear wall 20 relative to the side walls 22 allows the blade member 50 of the slide element 18 to abut the lower edge 28 of the rear wall 20 while the slots 24 in the extended side walls 22 (extended by the structural curved portion 30) extend beyond this point of abutment. This structural feature allows mount of the support members 12 between brackets 60 or moldings which are spaced oppositely apart by a distance equal to the vertical lengths of the blade members 32 and 50 and the length of the rear wall 20 of the slide lement 16. This distance is a minimum mounting spacing not heretofore obtainable.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A mounting rack for rifles and the like comprising a pair of laterally spaced support members, each support member comprising:

first and second slide elements, each slide element having means thereon for forming a slidable surface and a substantially planar support blade formed thereon, the plane of each support blade extending away from the planes of the slidable surfaces of the slide elements at an angle, the first slide element comprising a U-shaped longitudinal channel member forming a slide track, the channel member being comprised of a rear wall and two spaced side walls extending perpendicularly to the rear wall, the second slide element being receivable between the spaced side walls from a direction perpendicular to the rear wall, the side walls having laterally aligned elongated slots formed therein and spaced along free edges of the side walls, the support blade of the first slide element being attached to the uppermost end thereof; and, cradle means disposed on the second slide element and extending outwardly therefrom for receiving the object which is to be mounted on the mounting rack.

2. The mounting rack of claim 1 wherein the side walls of the first slide element are longer than the rear wall at the lower portion of the slide element, the lower edges of the side walls curving from the rear wall to form curved portions of said side walls, the curved portions having at least portions of the lowermost slots formed therein.

3. The mounting rack of claim 2 wherein the second slide element has elongated slots formed therein and spaced along the length thereof, at least portions of the slots in the first and second slide elements aligning along the full travel of the second slide element within the first slide element.

4. The mounting rack of claim 3 and further comprising fastener means extendible through the aligned portions of the slots in the first and second slide elements for fastening the elements together in a desired relative position.

5. The mounting rack of claim 4 wherein the first slide element has extended tongue elements formed at the upper portion thereof for mounting hats or other articles thereon.

6. The mounting rack of claim 4 and further comprising bracket means mountable on a surface to which the mounting rack is to be mounted, the bracket means being vertically spaced from each other and comprising receiving means into which upper edge portions of the blade members are received.

* * * * *